United States Patent [19]

Bouchard et al.

[11] 4,191,947

[45] Mar. 4, 1980

[54] INTRUSION ALARM SYSTEM

[75] Inventors: Andre C. Bouchard, Peabody; James C. Morris, Wakefield, both of Mass.; Robert L. Garrison, Henniker, N.H.

[73] Assignee: GTE Sylvania Incorporated, Stamford, Conn.

[21] Appl. No.: 940,062

[22] Filed: Sep. 6, 1978

[51] Int. Cl.[2] ..... G08B 13/08

[52] U.S. Cl. ..... 340/531; 340/541; 340/545; 340/548; 116/17

[58] Field of Search ..... 340/303, 531, 539, 541, 340/545, 548, 385; 116/11, 15, 17, 81, 83, 87, 105

[56] References Cited

U.S. PATENT DOCUMENTS

| | | | |
|---|---|---|---|
| 2,905,762 | 9/1959 | Rettie et al. | 340/531 |
| 3,714,647 | 1/1973 | Litman | 340/531 |
| 4,001,805 | 1/1977 | Golbe | 340/531 |
| 4,117,462 | 9/1978 | Miller | 340/539 |

*Primary Examiner*—Alvin H. Waring
*Attorney, Agent, or Firm*—Edward J. Coleman

[57] ABSTRACT

An intrusion alarm system and method is provided which includes one or more sound pulse transmitters that are triggered upon the opening of an entryway, such as a door or window, to produce a high-intensity sound pulse having a decibel level above a predetermined minimum. For example, each transmitter may comprise a percussive photoflash unit in combination with a pyrotechnic device which responds to the radiant output of the fired photoflash unit to emit the intense sound pulse. A centralized detector responds to the sound pulse above a predetermined threshold level to produce an alarm signal. Preferably, the detector comprises an electroacoustical transducer arrangement which provides the dual functions of both sound pulse detection and generation of an audible alarm.

14 Claims, 4 Drawing Figures

INTRUSION ALARM SYSTEM

RELATED PATENT APPLICATIONS

Ser. No. 803,563, filed June 6, 1977, now U.S. Pat. No. 4,130,081, Ronald G. Blaisdell et al, "Activation Means for Flashlamp Article", assigned the same as this invention.

Ser. No. 803,565, filed June 6, 1977, now U.S. Pat. No. 4,130,082 Andre C. Bouchard et al, "Flashlamp Assembly For Providing Highly Intense Audible and Visual Signals", assigned the same as this invention.

Ser. No. 940,061, filed concurrently herewith, and now abandoned, James C. Morris and Robert L. Garrison, "Audio-Detector Alarm", assigned the same as this invention.

Ser. No. 803,564, filed June 6, 1977, now U.S. Pat. No. 4,130,083, Andre C. Bouchard et al, "Activating Mechanism for Flashlamp Article", assigned the same as this invention.

Ser. No. 831,008, filed Sept. 6, 1977, now U.S. Pat. No. 4,146,356, Paul M. Marecek and John W. Shaffer, "Flashlamp Article Having Internally Located Combustible Member", assigned the same as this invention.

Ser. No. 839,652, filed Oct. 3, 1977, now U.S. Pat. No. 4,116,615, Andre C. Bouchard et al, "Door-Actuated Activation Means For Flashlamp Article", assigned the same as this invention.

BACKGROUND OF THE INVENTION

This invention relates to alarm systems and, more particularly, to intrusion alarm systems that are useful for conveniently and inexpensively providing protection against unauthorized entry into given area.

A commonly used intrusion alarm system for detecting unauthorized entry into buildings is the electrically wired type wherein all doors and windows are wired together in one or more common circuits such that when the electrical circuit is broken, as could occur with an unauthorized entry, an alarm or signal device is activated. Such systems can be quite sophisticated, often incorporating fail-safe or anti-defeat circuitry whereby a high degree of reliability is provided. However, since skilled electricians are required to install and service these systems and since local building codes often impose expensive restrictions on wiring buildings, the installation and maintenance of such wire systems can be quite costly.

To reduce the comparatively high costs of such wire systems, various types of unwired systems using radiant beam communication instead of wiring have been employed, including the use of battery-powered radio transmitters at each of the doors and windows. The last-mentioned type radiant beam system, however, can also be comparatively expensive since a separate battery-powered radio wave or sonic transmitter is usually required for each window and door. Furthermore, such systems can be relatively unreliable due to battery failure and, thus, require frequent inspection, testing and servicing. A further disadvantage of these radiant wave systems is that the alarms may often be inadvertently triggered by spurious noises or spurious radio signals since the more highly selective the system, the greater is its cost and complexity.

Another type of so-called unwired radiant beam system is described in U.S. Pat. Nos. 3,714,647 Litman and 3,805,257 Litman et al, wherein signal devices (transmitters) are described which incorporate multilamp photoflash units. The preferred units are the percussive type devices sold under the name "MAGICUBE", which are produced by the assignee of the present invention. Triggering the percussive flashlamps in these units is accomplished via a spring-loaded pivotal arm which moves in response to some external activation, e.g., pulling of an attached cord or chain. In addition to providing a highly intense flash, e.g., 2,000 beam candle power seconds, the devices are optically coupled to an electric circuit which includes a photovoltaic cell or similar light detector which becomes activated upon receipt of the intense flash of light from the fired photoflash lamps. Assuming a plurality of light pulse transmitters are employed to protect a given area, a centralized light pulse detector is spaced from and in optical communication with all of the transmitters. In order to avoid a false alarm response to ambient lighting conditions, the detector includes a discriminator circuit which responds only to the predetermined transient characteristic of the transmitted light pulse from the photoflash units. Upon discriminatingly detecting the transmitted light pulse, the detector circuitry activates any one or more of a variety of alarm signals. The detector circuits may be energized by either AC or DC sources, or both.

A common disadvantage of above-discussed optically coupled alarm systems employing electronic light-activated components spaced from light-source transmitters involves the possibility of physical interruption of the activating light path by a window shade, drape, or item of furniture, etc. Such an interruption, of course, prevents the transmitted light signal from activating the necessary alarm warning. Further, the detector circuitry can still be comparatively complex and costly, even in the case of the system described by the Litman patents.

SUMMARY OF THE INVENTION

Accordingly, it is an object of the present invention to provide an improved intrusion alarm system and method.

A particular object of the invention is to provide an intrusion alarm system of comparatively low cost and simplified structure which does not require wiring between the transmitter and detector components.

A further object of the invention is to provide a reliable intrusion alarm system having a flexible alarm signal capability employing self-powered transmitting devices.

These and other objects, advantages, and features are attained, in accordance with the principles of this invention, by a system comprising a sound pulse transmitter coupled to an entry means and including triggering means for activating the transmitter to emit a high-intensity sound pulse having a predetermined discriminating characteristic upon intrusion of the entry means. A sound detector is spaced from and in sound communication with the transmitter and includes discriminating means selectively responsive to the predetermined characteristic of the sound pulse and substantially unresponsive to ambient sound conditions from other means. Means responsive to the detector produces an alarm signal upon detection of the sound pulse. In a preferred embodiment, the predetermined discriminating characteristic of the sound pulse comprises a maximum sound level above a predetermined minimum. A particularly useful transmitter device comprises a percussively ignitable photoflash unit in combination with a pyrotechnic device operative to emit an intense sound pulse in response to the radiant output of the photoflash unit when that unit is triggered to fire. A preferred detector comprises an electroacoustical transducer in combination with an amplifier having input and output coupled to the transducer; in this instance, the discriminating means comprises means for biasing the amplifier. The transducer can provide the dual function of both sound pickup and generator. Accordingly, upon receiving a sound above a predetermined threshold, the transducer activates the amplifier, which in turn drives the transducer to produce an audible alarm. In addition, the output of the detector amplifier can control an AC switch for energizing alternative alarm signal apparatus.

The use of a transmitting device such as the above-mentioned percussive photoflash unit in combination with a pyrotechnic element significantly enhances system reliability. Firstly, the percussive photoflash unit is self-powered upon intrusion of the entry means and requires neither a battery nor an AC connection. The resulting intense sound pulse emanated from the pyrotechnic element in response to triggering of the photoflash unit provides a short-duration first order alarm, in addition to a startling effect on any intruder. The transducer-amplifier type of detector is particularly suitable for low-cost compact packaging. For example, use of a dual functioning transducer eliminates the need for a separate intrusion-signal sensing device and a separate continuous alarm-generating device, as both functions are combined in a single, comparatively simple unit. Reliability is further enhanced as the sound pulse is discriminatingly detected according to a predetermined characteristic, such as sound level, and is substantially unresponsive to ambient sound conditions from other means. Further, the sound pulse system of the present invention is particularly advantageous over the prior art optically coupled systems in that the transmitted sound pulse will not be substantially altered by intervening objects positioned between the transmitting device and the detector, whereas a transmitted light path can be totally blocked by an object obstructing the "sight" of a photodetector. Thus, since sound travels around corners, it would be possible to have one detector for servicing several rooms having entries protected by transmitters. This provides the advantage of minimizing the cost of a total protection system for the user.

BRIEF DESCRIPTION OF THE DRAWINGS

This invention will be more fully described hereinafter in conjunction with the accompanying drawings in which.

DESCRIPTION OF PREFERRED EMBODIMENT

Figure 1:
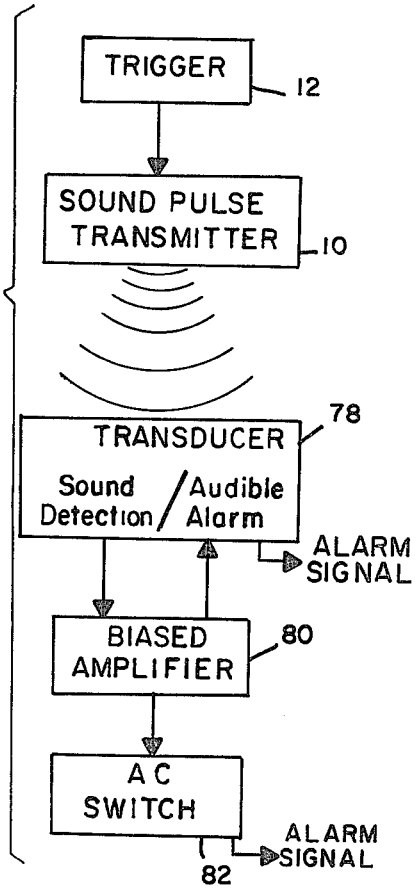
FIG. 1 is a block diagram of a preferred embodiment of an intrusion alarm system according to the invention.

The present invention is concerned with a method for detecting the presence of an intruder entering into a proscribed area and providing any one or more of a variety of alarm signals in an economical, reliable, and efficient manner. The block diagram of FIG. 1 illustrates a preferred embodiment of a system for carrying out this detection method. The system employs comparatively inexpensive components and is suitable for ease of installation by the average homeowner.

Figure 2:
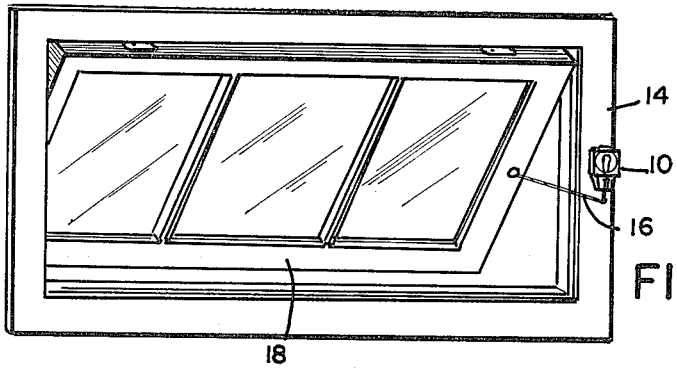
FIG. 2 is a schematic illustration of a sound pulse transmitter unit interconnected to a window.
Figure 3:
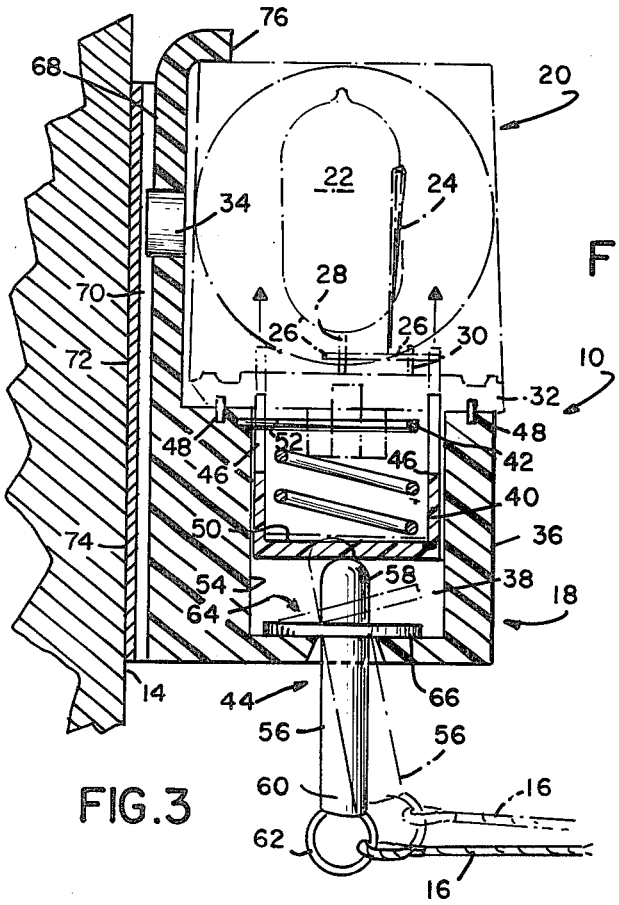
FIG. 3 is an enlarged sectional view illustrating details of one preferred type of transmitter unit.

The first step is to sense the presence of an intruder at one or more peripheral locations circumscribing the area being protected. For example, in an area as a room or building, sensing devices could be located at one or more of the entry means, such as doors or windows, and respective physical couplings provided for activating a respective sensing device in response to an act of intrusion. According to the present invention, as shown in FIG. 1, this sensing function at each entry means is provided by a sound pulse transmitter 10 arranged to be activated by a trigger means 12 which is coupled to the respective entry means. As illustrated in FIGS. 2 and 3, according to a preferred embodiment of the invention, the transmitter 10 is preferably a small, inexpensive device that may be easily attached to a window frame 14 or door frame and easily connected by a short chain or string 16 to the openable window 18, door or other access opening member. Any number of such devices may be employed in a room or building since each unit is completely independent in operation from the other.

A preferred transmitter device 10 is shown in FIG. 3 and described in the above-mentioned copending application Ser. No. 803,563, Blaisdell et al. The device comprises a holder and triggering assembly 18 upon which is removably mounted a multilamp photoflash unit 20 of the type currently available on the market under the name "MAGICUBE" and manufactured and sold by the assignee of the present invention. The photoflash unit includes four percussively-ignitable flashlamps 22 (one shown) and a pre-energized striker spring 24 associated therewith. Spring 24 includes a striker arm 26 which moves to strike and deform the primer 28 of lamp 22 when released from its retained position, said retention being maintained by an upstanding element 30. Arm 26 is shown in the striking position by numeral 26' in FIG. 3.

Spring 24 and primer 28 are preferably mounted within a base portion 32 of the photoflash unit. As described in the above-mentioned copending application Ser. No. 803,565 of Bouchard et al, the device 10 further includes at least one pyrotechnic device or element 34 positioned in operative relationship to one of the flashlamps 22 for receiving the radiant energy therefrom in the form of light and/or heat. Accordingly, pyrotechnic device 34 will provide a highly sound pulse in response to receipt of this energy.

In accordance with the present invention, the sound pulse must have a predetermined discriminating characteristic in order to render it distinguishable from the ambient sound conditions in the area. Although this discriminating characteristic may be selected to correspond to any of a number of the parameters of sound pulse, such as duration, frequency response, etc., a preferred discriminating characteristic according to the present invention comprises the maximum sound level of the pulse above a predetermined minimum level. A minimum level which has been found to be acceptable in terms of reliability, cost, and safety is about 147 decibels at 10 inches from the source. Hence, in the system of FIG. 1, the maximum sound pulse generated by the transmitter 10 should be at least 147 decibels at 10 inches from the transmitter 10. It will be understood, however, that minimum sound levels other than the 147 decibel level mentioned above may be desired for different applications. For example, in one specific implementation of the system described herein, we have selected 156 decibels at 10 inches from the source as a particularly suitable minimum level.

An example of a pyrotechnic composition which may be suitable for use in device 34 is that used in "SUPER BANG CAPS", which are currently distributed by the Ohio Art Company, Bryan, Ohio. Each of the caps contains a pyrotechnic composition of potassium chlorate, red phosphorus, manganese dioxide, sand, and glue. The content of each cap is less than 0.20 grains. Pyrotechnic compositions known as "Armstrong's mixtures" may also be used with the present invention. These compositions typically include potassium chlorate within the range of about 67 to 81%, phosphorus from about 8 to 27%, sulphur from about 3 to 9%, and precipitated chalk from about 3 to 11%. All of these percentages are by weight of the total mixture. The above formulations when encapsulated provide a sound pulse output signal within the range of about 130 to 155 decibels as measured at a distance of 10 inches from the source, but the quantity in each cap or pyrotechnic element may be increased to obtain any higher sound level that may be desired.

Assembly 18 comprises a casing 36 which defines a chamber 38 therein. An activator 40 movably oriented within chamber 38, biasing means 42 for biasing activator 40 to a first, non-firing position, and engagement means 44 for engaging activator 40 to cause it to move from the first, non-firing position to a second position. This second position (shown in phantom in FIG. 3) represents the firing position for the triggering assembly 18 wherein an upstanding engagement member 46 has moved to engage and release a respective striking arm 26 on spring 24. Release of arm 26 effects successful firing of the flashlamps 22 associated therewith. Activator 40 includes four members 46 (not all are shown in FIG. 3) when the activator is used to fire a photoflash unit 20 containing four flashlamps 22 therein.

Photoflash unit 20 is aligned on casing 36 using a plurality (e.g. four) of alignment pins 48 mounted in the casing and adapted for inserting within corresponding apertures in the base 32. Biasing means 42 is preferably a helical spring which maintains engagement with an internal wall 50 of the activator 40 to act thereagainst. Of course, other types of biasing means may be employed other than the illustrated helical spring. It is preferred to securedly position an end 52 of spring 42 within an internal wall 54 of casing 36. This prevents spring 42 from becoming removed from within casing 36 when the photoflash unit 20 is removed therefrom.

The engagement means 44 comprises an elongated member 56 having a first end 58 in engagement with activator 40 and a second opposing end 60 extending from casing 36. A cord 16 is secured (e.g. hooked) to a ring 62 positioned within second end 60. Means 44 further includes means 64 for pivoting elongated member 56, said means preferably comprising an annular ring member 66 positioned about the elongated member 56 between ends 58 and 60. Ring 66 crosses member 56 to pivot about a point within chamber 38 whereby member 56 will be upwardly displaced to cause actuator 40 to move likewise.

Casing 36 further includes an upstanding wall 68 which includes a longitudinal channel 70 therein. Within wall 68 is positioned at least one of the aforementioned pyrotechnic devices 34, said device being adjacent one of the lamps 22 as a result of wall 68 being located adjacent photoflash unit 20. Pyrotechnic device 34 is positioned within wall 68 to have access to channel 70 whereby the audible output from device 34 will pass through the channel. The assembly is shown as secured to an external surface 14, (e.g. a door or window casement). A flat metallic strip 72 may be used against the surface 14. The substantially flat surface 74 of the casing 36 or strip 72 is adapted for mating with the external surface 14, whereby the assembly may be secured to surface 14 by an adhesive (not shown) such as a 2-sided tape. Wall 68 includes a retaining means (portion 76) projecting from the wall 68 and engaging the top of photoflash unit 20 when the unit is positioned on the casing 36.

The preferred material for most of the components of the assembly is high-impact polystyrene, and the preferred material for helical spring 42 is 0.030 music wire.

Returning now to the block diagram of FIG. 1, the system further includes a centralized sound detector in sound communication with the one or more transmitter devices 10 that may be spaced apart on various doors or windows. This detector responds to the sound pulse produced from one of the photoflash-pyrotechnic transmitters to produce an audible alarm signal that warns of an unauthorized entry into the protected area. However, since these intrusion alarm systems may be employed at locations having various ambient sound conditions and changes therein, it is required that the detector be insensitive to such ambient sound conditions yet reliably respond to the sound pulse from any one of the triggered transmitters. This is performed by employing discriminating circuitry in the detector that permits response only to sounds having the particular characteristics of the transmitted sound pulse. According to a preferred embodiment of the invention, the detector comprises an electroacoustical transducer 78 coupled with an amplifier 80 in a manner providing a threshold-triggered oscillator arrangement. In the present instance, where the predetermined discriminating characteristic of the sound pulse is its maximum level above a predetermined minimum, the discriminating circuitry comprises the means for biasing the amplifier. The transducer 78 picks up or senses the transmitted sound pulse and responds by providng a voltage output to the biased amplifier 80; if the magnitude of the voltage exceeds the predetermined bias threshold level, the amplifier provides an output for driving the transducer to produce an audible alarm signal. In addition, the output of amplifier 80 can be coupled to an AC switch 82 for activating other pieces of apparatus such as louder alarms, television receivers, light bulbs, or radio transmitters for transmitting intrusion information to other areas.

Figure 4:
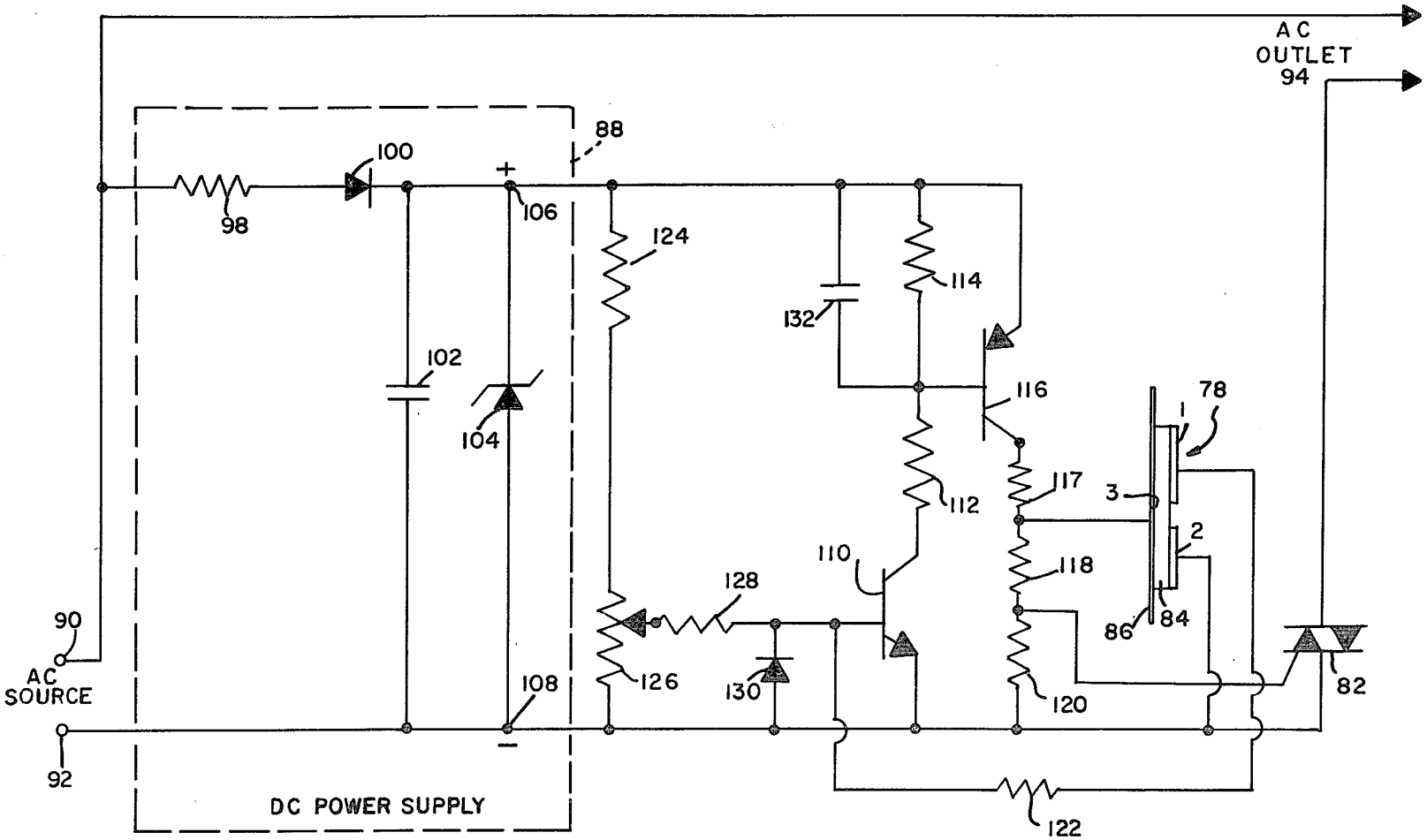
FIG. 4 is a schematic circuit diagram of one preferred type of sound detector and alarm signaling arrangement.

FIG. 4 illustrates the circuit details of one preferred detector-alarm circuit that has been found capable for responding to the sound pulse produced from a transmitter 10 (having a maximum level of at least 156 decibels at 10 inches from the source) from as far away as ten feet from the receiver, yet being insensitive to ambient sound produced in a closed room. This and related circuits are described in detail in the above-mentioned copending application Ser. No. 940,061. As shown, the transducer element 78 is a three-terminal diaphragm-supported piezoelectric element, such as that described in U.S. Pat. No. 3,815,129. Such a transducer includes a piezoelectric element 84 suitably bonded to a metal disc 86 which serves as a diaphragm. The piezoelectric element includes a piezoelectric cyrstal in the shape of a disc and terminals 1, 2 and 3 serving as electrodes composed of thin sheets or coatings of electrically conductive material, such as silver, applied to the sides of the crystal. A suitable material for the piezoelectric crystal would include a lead, zirconium, titanium composite, for example. The metal disc 86 which serves as the diaphragm of the transducer may be fabricated from a metal such as brass.

The transducer is shown in combination with a switching amplifier circuit powered by a source of DC voltage 88. Although the DC supply 88 may comprise a battery, in this instance it is illustrated as comprising a rectifier circuit energized from a source of AC voltage represented by the terminals 90 and 92. The AC terminals not only provide a source of power for rectifier circuit 88, but are also connected to an AC outlet 94. More specifically, AC terminal 90 is connected directly to one side of the AC receptacle 94, while AC terminal 92 is connected through a controlled switching device, such as triac 82, to the other side of the AC outlet.

Rectifier circuit 88 comprises a series resistor 98 and diode 100 connected to a positive terminal junction with parallel-connected filter capacitor 102 and Zener diode 104. In a preferred embodiment, a 125 volt AC input is applied to the terminals 90 and 92, and Zener diode 104 is selected to regulate the voltage of the DC supply at about 30 volts. This permits a more precise and reproducible adjustment to the level of noise or mechanical disturbance needed to initiate the alarm. The positive and negative terminals of the DC supply 88 are represented by terminals 106 and 108, respectively.

The oscillator circuit includes a first switching amplifier comprising a transistor 110 having collector-emitter electrodes connected in series with a voltage divider, comprising resistors 112 and 114, across the DC terminals 106 and 108. Also connected across the DC supply terminals is a circuit combination comprising a switching amplifier consisting of a transistor 116 having a base electrode connected to the junction of resistors 112 and 114, an emitter electrode connected to DC terminal 106, and a collector electrode connected to the DC terminal 108 through a voltage divider comprising resistors 117, 118 and 120. The junction of resistors 117 and 118 is connected to drive terminal 3 of the transducer, while the voltage output terminals 1 and 2 of the transducer 78 are coupled in a positive feedback path to the input of the first switching amplifier, transistor 110. More specifically, terminal 2 is connected to the reference line from DC terminal 108, and transducer terminal 1 is connected through a resistor 122 to the base of transistor 110. The first switching amplifier, transistor 110, is biased to be normally non-conducting by a circuit including resistors 124 and 126, which are series connected across DC terminals 106 and 108, and a resistor 128 connected in series between the base of transistor 110 and resistor 126. When transistor 110 is in a non-conducting state, transistor 116 is also biased to be non-conducting. Resistor 126 may have a fixed value, or as illustrated, it may comprise a potentiometer, in which case resistor 128 is connected to the variable tap on potentiometer 126. The base bias circuit of the first amplifier is completed by a diode 130 connected as illustrated across the base and emitter electrodes of transistor 110. Diode 130 serves two purposes: (a) to aid in the leakage or discharge of the voltage developed between terminals 1 and 2 of the transducer; and (b) it also serves to reduce the possibility of breakdown voltages reaching the base to emitter junction of transistor 110. The bias on transistor 110, which may be selectably adjusted by the potentiometer 126, is the means by which the predetermined threshold level of the circuit is selected. Detection of sound above this predetermined threshold level triggers the circuit into oscillation.

Resistors 118 and 120 are chosen to have a time constant in combination with the capacitance of the piezoelectric element 84 to allow the voltages developed on terminals 2 and 3 to discharge rapidly enough during the off time of transistors 110 and 116 so that the transducer can restore itself to its original position and carry beyond that to the reverse position. Coupling resistor 122 is chosen to suppress undesired oscillations of frequencies other than the basic frequency of the piezoelectric crystal. The capacitor 132 is connected across resistor 114, and thus across the base-emitter junction of transistor 116 to reduce the frequency response of transistor 116 so that the second switching amplifier will not respond to line transients and radio frequency pickup as readily as would if that capacitor were not included.

The oscillator circuit provides control of AC switch 82 by means of a connection between the junction of resistors 118 and 120 and the control gate of triac 82.

The diaphragm-supported piezoelectric element comprising transducer 78 is held mechanically so that it is free to oscillate once it is set into motion from a noise or other disturbance. As described, the piezoelectric element is electrically connected to the switching amplifier arrangement in a positive feedback loop configuration. If the device is disturbed from its resting position by a predetermined amount of noise or a direct mechanical perturbation, it will set the system, that is the amplifier and piezoelectric element, into a sustained oscillation producing an alarm signal. The device can only be shut off by removing the power from terminals 106 and 108, or terminals 90 and 92.

To enhance the acoustical output from the device, the transducer 78 may be mounted in a Helmholtz resonator as described in U.S. Pat. No. 4,042,845.

In a preferred embodiment, the frequency of the oscillations of an audio type alarm are in the neighborhood of two to three KHz. The circuit may also be designed, however, such that oscillations are at ultrasonic frequencies above the normal hearing of humans to transmit information to other pickup devices. On the other hand, if the output is in the audible range, the device serves as an alarm in its own right. In addition to activating the transducer alarm, the voltage developed across resistor 120 during the conducting state of transistor 116 is applied to the control gate of triac 82. The pulses of voltage from this connection to the gate of the triac are sufficient to turn on the triac into a conducting state whereby the AC source 90, 92 is conductively connected to the output receptacle 94. This AC outlet 94 controlled by switch 82 can be employed to drive other pieces of apparatus as previously discussed.

Although the invention has been described with respect to specific embodiments, it will be appreciated that modifications and changes may be made by those skilled in the art without departing from the true spirit and scope of the invention. For example, the detector could be designed to sense both the signature and amplitude of the transmitted sound pulse, or it may respond to two or more successive pulses, in which case the transmitter would be designed to produce a selected succession of sound pulses.

What we claim is:

1. An intrusion alarm system comprising:

a sound pulse transmitter coupled to an entry means;

said transmitter including triggering means for activating said transmitter to emit a high intensity sound pulse having a predetermined discriminating characteristic upon intrusion of said entry means, said transmitter comprising a photoflash unit and means activated by the radiant output of said photoflash unit for emitting said sound pulse, a sound detector spaced from and in sound communication with said transmitter, said detector including discriminating means selectively responsive to said predetermined characteristic of said sound pulse and substantially unresponsive to ambient sound conditions from other means, and means responsive to said detector for producing an alarm signal upon detection of said sound pulse.

2. The system of claim 1 wherein said predetermined discriminating characteristic comprises a maximum sound level of said pulse above a predetermined minimum level.

3. The system of claim 2 wherein said sound pulse has a maximum sound level of at least 147 decibels at ten inches from the source.

4. The system of claim 2 wherein said sound has a maximum sound level of at least 156 decibels at ten inches from the source, and the maximum spacing of said detector from said transmitter is about ten feet.

5. The system of claim 2 wherein said detector comprises an electroacoustical transducer.

6. The system of claim 5 wherein said detector further includes an amplifier having an input coupled to the electrical output of said transducer, and said discriminating means comprises means for biasing said amplifier.

7. The system of claim 6 wherein said means for producing an alarm signal comprises means coupling the output of said amplifier to the drive of said transducer, said transducer additionally functioning to emit an audible alarm upon detection of said sound pulse.

8. The system of claim 7 wherein said system further includes a source of AC voltage, an AC outlet, and a controlled switch connected between said AC source and AC outlet and having a control terminal for rendering said switch conductive in response to a signal applied thereto, and said means for producing an alarm signal comprises means coupling the output of said amplifier to said control terminal of said switch.

9. The system of claim 1 wherein said photoflash unit includes a percussively-ignitable flashlamp and a pre-energized striker associated therewith, said striker being releasable to fire said flashlamp, said triggering means comprises means for releasing said striker in response to actuation by means coupled to said entry means, and said sound pulse emitting means comprises at least one pyrotechnic device located externally of and in operative relationship to said flashlamp to receive energy therefrom in the form of light and/or heat when said flashlamp is fired.

10. The system of claim 9 wherein said predetermined discriminating characteristic comprises a maximum sound level of said pulse above a predetermined minimum level.

11. The system of claim 10 wherein said detector comprises an electroacoustical transducer.

12. The system of claim 11 wherein said detector further includes an amplifier having an input coupled to the electrical output of said transducer, said discriminating means comprises means for biasing said amplifier, and said means for producing an alarm signal comprises means coupling the output of said amplifier to the drive of said transducer, said transducer additionally functioning to emit an audible alarm upon detection of said sound pulse.

13. The system of claim 1 including a plurality of said sound pulse transmitters each coupled to a respective entry means, each of said transmitters including triggering means for activating the transmitter to emit a high intensity sound pulse having a predetermined discriminating characteristic upon intrusion of said respective entry means, and wherein said sound detector is a centralized detector spaced from and in sound communication with said transmitters.

14. The system of claim 13 wherein said predetermined discriminating characteristic comprises a maximum sound level of said pulse aaove a predetermined minimum level.

* * * * *